US005444668A

United States Patent [19]

Sevik

[11] Patent Number: 5,444,668

[45] Date of Patent: Aug. 22, 1995

[54] ANECHOIC AND DECOUPLING COATING

[75] Inventor: Maurice M. Sevik, Potomac, Md.

[73] Assignee: The United States of America as represented by the Secretary of the Navy, Washington, D.C.

[21] Appl. No.: 35,114

[22] Filed: Apr. 30, 1979

[51] Int. Cl.[6] ..... H04K 3/00

[52] U.S. Cl. ..... 367/1

[58] Field of Search ..... 367/1, 162, 176; 181/0.5, 175, 198, 284, 291, 292, 293, 294, 296, 286; 252/62

[56] References Cited

U.S. PATENT DOCUMENTS 2,001,916 5/1935 Mazer ..... 367/1

3,615,961 10/1971 Meyer et al. ..... 181/296

*Primary Examiner*—Daniel T. Pihulic

[57] ABSTRACT

An anechoic and decoupling coating for use on the surface of an underwater structure for decoupling structural vibrations from the water and for absorbing waterborne acoustic waves directed toward the structure from an external source such as a sonar. The coating is an elastomeric matrix containing sealed air-filled cavities as well as random labyrinths of small water-filled passages running throughout and in open communication with a surface facing the water. Acoustic waves incident upon the water-facing surface cause time varying shear and bulk deformations within the matrix. As a result of these deformations, acoustic energy is dissipated by hysteretic damping of the elastomeric matrix as well as by viscosity due to water movement to and fro within the passages and into and out of the matrix.

The invention described herein may be manufactured and used by or for the Government of the United States of America for governmental purposes without the payment of any royalties thereon or therefor.

23 Claims, 2 Drawing Sheets

PRIOR ART

U.S PATENT 3647022

"ACOUSTICA" VOL. 25, NO. 5
PUBL. 1971

ANECHOIC AND DECOUPLING COATING

BACKGROUND OF THE INVENTION

1. Field of the Invention

The invention relates to the field of sound wave absorption. More specifically, it relates to an anechoic and decoupling coating of an elastomeric matrix adapted to be secured to the outer surface of an underwater structure for absorbing vibrations radiating therefrom and for absorbing, with minimal reflection, waterborne sound waves directed toward the underwater structure from an external source, such as sonar. The elastomeric matrix may be a polymer such as rubber which has its hysteretic absorptive capacity enhanced by introducing time varying shear deformations in cooperation with viscous damping whereby acoustic wave energy is converted into heat.

The absorptive capability of anechoic coatings is accomplished by two mechanisms, hysteretic damping and viscous damping. An elastomeric coating, bonded to the external surface of the structure to be protected, comprises a rubber-like base material made porous by a large number of extremely small passages, and contains rubber particles, each of which hermetically seal a core filled with air, or particles of metal or dense rubber. Acoustic waves incident upon the coating deform the material which dissipates the acoustic energy via hysteretic damping, arising from a phase difference between the stress and the strain of the material. The small passages, filled with water when the coating is submerged, dissipate acoustic energy by viscous damping which occurs when water is forced through the passages as the material is deformed.

2. Brief Description of the Prior Art

Much effort has been directed in the past to materials for absorbing sound in air. The prior art is replete with panels formed of fibers and foams, all, in one form or another, defining a mass having cells, cavities or openings, or combinations thereof, adapted to absorb or otherwise hinder the passage or reflection of sound waves. Efforts were made to reduce surfaces capable of secondary radiation. It is known, for example, to provide a myriad of hollow glass spheres interspersed randomly in a mass for dissipating some sound energy by refraction as the waves travel through their surfaces to the vacuum inside. In short, masses are constructed which tend to confuse incident sound waves, and in the process, dissipate their energy for increased absorption and reduced echo. Typical examples of such materials are shown in U.S. Pat. Nos. 2,001,916; 2,036,913; 3,080,938; 3,132,714; 4,079,162; and 4,097,633.

The art of absorbing waterborne sound such as with anechoic or decoupling coatings where the material is in actual contact with the water is less developed because the need is more recent. Early methods of sound absorption were developed for establishing silent chambers for transducer testing. Many methods have been proposed for external coating for submarines to absorb probing underwater sound waves produced by sonar transducers and thereby minimize echo for preventing active detection.

It is known in the prior art, for example, to use rubber panels containing air filled cavities to dissipate acoustic waterborne energy through hysteretic loss by shear deformations. This system has as a limitation the fact that the sound absorbing and anechoic characteristics of cavity type materials such as air in rubber are affected by underwater pressure and temperature and, therefore, a material found acceptable for sound absorption at one hydrostatic pressure or temperature would be less effective at another.

It is further known to reflect sound waves to prevent their echo to a sender, to introduce materials in a coating for causing out of phase strain during an acoustic pressure cycle, or introduce viscous damping by forcing a trapped liquid to flow through a constricting orifice rather than through the more effective passages of the application, for converting acoustic energy into heat energy. Two examples of patented, or otherwise known prior art for using this technique or its equivalent absorbing waterborne sound are illustrated in FIGS. 3*a* and 3*b*. They both involve a captured liquid which, in response to incident waterborne sound waves, is caused to flow back and forth through small constricting orifices by which acoustic energy is converted into heat energy. FIG. 3*a*, which is a cross-sectional representation of one form of this technique, is disclosed in U.S. Pat. No. 3,647,022. The illustrated absorbing unit 1 is one of a plurality of units connected together in an array or blanket. A flexible face or membrane 113 receives incident waterborne sound waves 15 on its face resulting in induced oscillations. This imparts movement to a liquid 114 captured between the membrane 113 and a fissured cavity having small openings for allowing restricted flow. As the liquid 114 is caused to flow through these constricting orifices, a viscous loss occurs and acoustic energy is converted into heat energy.

FIG. 3*b* illustrates an arrangement from an article published in "Acoustica" in 1971. Oil 214 is captured between a flexible water facing diaphragm 213 on one side and a cellular rubber filled backing 215 on the other. Movement is imparted to the oil by the oscillating diaphragm, and it is forced back and forth through the small openings of a screen mesh 216, the equivalent of the orifices in FIG. 3*a*, for dissipation of energy.

It will be noted in the two illustrated instances of prior art, they both employ fluids being forced through constricting orifices in response to sound waves for dissipating energy. It is to be noted that the diaphragm in each instance is impervious and prevents intermixing of the contained fluid with the water in which the device is submerged. In neither case does water enter the sound absorber. In contrast, the invention of this application has capillary like passages and requires that the liquid (water), in which the matrix is submerged, enter these passages in the matrix and is caused to move to and fro in the passages by the acoustic wave for dissipation of energy. Furthermore, the constriction employed by this invention are extended passages rather than orifices or their equivalent, such as the screen in FIG. 3*b*. The use of the ambient fluid in the passages minimizes any impedance mismatch at the surface of the material.

SUMMARY OF THE INVENTION

The invention relates to an anechoic and decoupling coating for application to the outside of a water submerged structure to absorb structure vibrations and to intercept and absorb incident waterborne acoustic waves directed thereagainst from a remote source, such as a sonar, to minimize their reflection for camouflaging the structure to detection.

The coating comprises an elastomeric matrix of polymer such as a lossy rubber with a random labyrinth of small passages open to a surface facing the water in communication therewith. The matrix further includes numerous bodies such as hard rubber, metallic parts or hermetically sealed air cores throughout for establishing an acoustic mismatch and introducing time varying shear deformation in the matrix upon receiving incident acoustic waves for causing water movement in the passages, thus dissipating acoustic energy in the form of heat.

Therefore, a primary object of this invention is to provide a coating for absorbing acoustic energy.

Another object of this invention is to provide a coating for the surface of an underwater structure to absorb internal vibrations radiating from that structure and to absorb waterborne acoustic energy directed toward the structure from an external source to prevent echo and thereby camouflage its existence.

A further object of this invention is to provide a coating having an elastomeric matrix including a labyrinth of meandering water-filled capillary size passages communicating with the water whereby incident sound waves striking the matrix causes time varying shear waves and movement of the water in the passages whereby sound energy is converted to heat energy.

Other objects of the invention will become apparent upon consideration of the specification and drawings.

DESCRIPTION OF THE INVENTION

All objects in the path of transmitted sound waves produce echo, whether in air or in water, and their detectability depends in part on the magnitude of the reflection. One way of reducing active sonar detection is by diverting the reflected waves away from the sender by altering the shape of the reflecting structure. This is not a practical solution for it is not known from which direction probing sound waves will be received. A more practical solution is obtained by the application of a coating on the structure for preventing internally generated vibrations from radiating outwardly into the water and for absorbing waterborne sound waves directed toward the structure from an external source such as a sonar. The present invention contemplates a coating for absorbing these sound waves.

Presently known methods of dissipating acoustic energy incident upon a sound reflective surface is to provide a coating which absorbs sound waves either by internal hysteretic damping or by viscous loss through a contained liquid. Waterborne acoustic energy or sound waves incident upon a coating are dissipated by hysteretic damping arising from phase differences between stress and strain during an acoustic pressure cycle. The acoustic energy is thereby converted into heat energy. This conversion is present when elastomeric (rubber-like) coating materials undergo time varying sheer deformations. This is a cyclic or repetitive deformation as distinguished from a simple volume deformation, which would occur from pressure alone such as would be exerted by sea water at submarine submerged depths. Another form of acoustic energy conversion employs viscous absorbers, where a liquid is forced to flow through constrictions in response to cyclic or repetitive forces thereby again dissipating acoustic energy as heat.

Whether the hysteretic loss or viscous loss principle is employed the impedance of the coating must closely match the impedance of water at their interface, otherwise there will be reflections of the energy wave without absorption. The impedance may increase, however, from the interface progressively inwardly into the absorbing material.

The above references to methods in the prior art are not all inclusive but are made to show examples of attempts to solve the problem of absorbing active sound detection for camouflaging a structure in water to make it invisible. It will be noted that the prior art discloses impervious diaphragms for preventing the water, in which the sound absorbing material is submerged, from entering the interior of the sound absorbing material itself. In the present invention the converse is true because it is an object to actually admit water into the interior of the coating matrix for purposes to be described hereinafter.

Figure 1:
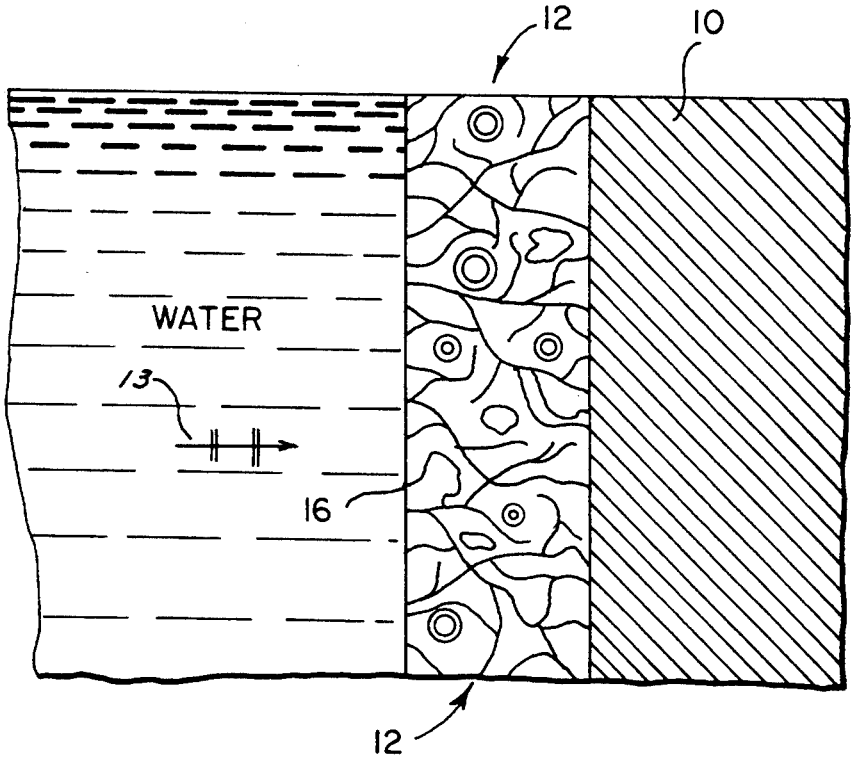
FIG. 1 is a sectional representation of the coating secured to the outer face of an underwater structure.
Figure 2:
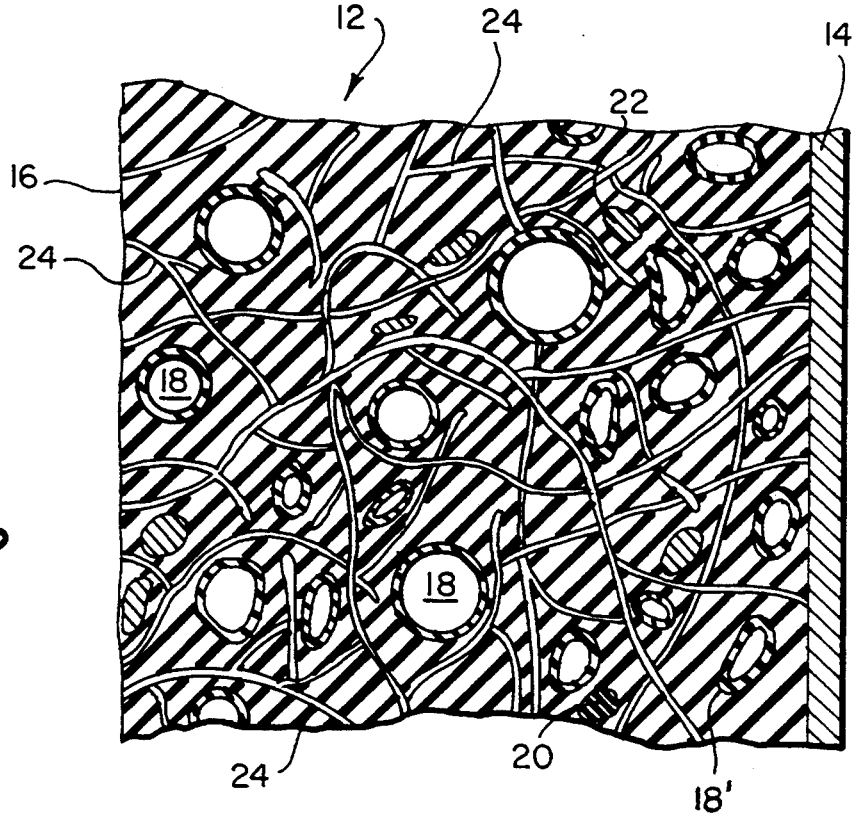
FIG. 2 is a greatly enlarged cross-sectional representation of the coating matrix for illustrating the nature of captured bodies and labyrinth of small passages open to water on one side or face.
Figure 3A:
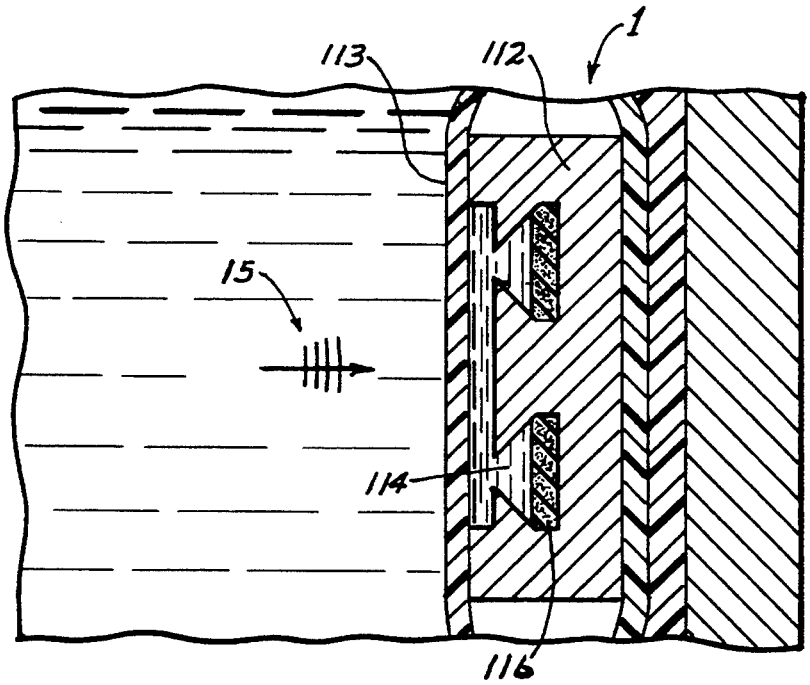
FIG. 3*a* and FIG. 3*b* represent examples of prior art.
Figure 3B:
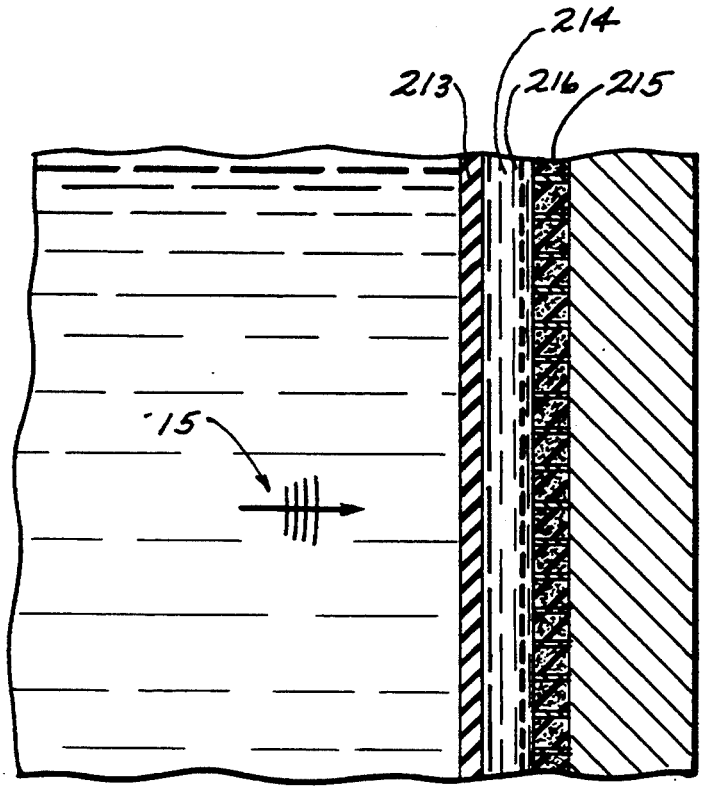

Referring to the drawings, there is illustrated in FIG. 1, an underwater structure such as a portion of a submarine or surface vessel hull or plating to which an anechoic and decoupling coating 12, according to the present invention, is applied. The matrix forming coating 12 may be secured to the outer face of the structure 10 directly by bonding between their mating surfaces, or indirectly by bonding between the coating and a backing plate, which itself is then bonded or otherwise mechanically secured to the face of structure 10. The matrix outer surface or face 16 which is substantially flat or planar interfaces with water (usually sea water) in which it is submerged. In FIG. 2, there is shown in greatly enlarged cross-sectional representation the internal construction of matrix 12 and backing plate 14 to which it may be bonded as an intermediate between the coating 12 and hull structure 10. While the coating may be bonded directly to plating 10, it is considered possible to first bond it to backing plate 14 and then removably secure the backing plate to the hull structure as by bolts or studs. The outer face of the matrix is generally smooth; however, it will normally project the contour of the underneath surface on which it is secured.

Matrix 12, an elastomeric polymer material having high energy absorptive properties such as a nitrile rubber, by itself will have some dynamic response causing out of phase cyclic deformations in response to incident sound waves. Randomly disposed throughout this matrix is a myriad of regular and irregular shaped bodies of different sizes and impedance characteristics for establishing additional impedance mismatch. These include elastomeric rubber-like bodies, 18, 18', some of which may be spherical, which hermetically seal a void or a core filled with gas such as, but not limited to, air. Round or irregular shaped bodies 20 are formed of solid resilient rubber-like material. Bodies 22, formed of hard material such as metal, are also randomly embedded in the matrix. These bodies may be mixed with the batch during processing to form the matrix. For the purposes herein described, there may be an intermix of body sizes and kind, or they may all consist of one type. The inclusion of these bodies in the matrix are for establishing regions of impedance variation as each body has a separate path for sound waves incident thereupon. Since two adjacent materials will have respective speed of sound transmission, the wave propagation through sections will be out of phase to thereby cause cyclic shear deformations within the surrounding matrix. These bodies may consume a variable percentage of the matrix volume ranging from a few percent to as high as around 70%, depending upon the specific performance requirements of the intended application. In the configuration described so far, acoustic energy in the form sound waves would be dissipated by hysteretic damping alone.

This invention provides additional damping of a viscous type. The matrix is made porous by incorporating a large number of randomly disposed extremely small capillary size hair-like passages or openings 24 in the range of 1/1000 to 1/100 inches. They meander throughout the matrix in the form of labyrinths, many passages of which are intersecting and interconnecting. These passages bypass embedded bodies 18, 18', 20 and 22. Preferably they do not penetrate the back side of the matrix; however, if they do they are sealed at their interface with backing plate 14 or with hull plating 10 to which the coating is bonded. However, numerous passages extend through face 16 of the matrix for open communication with the water in which the matrix is submerged. Passages 24 are adapted to fill with water. These passages may consume up to about 25% of the volume of the matrix. All passages may be of the same size, within the ranges above indicated, or in any combination of sizes. Their cavities fill with water when the matrix is submerged. Water flows throughout the labyrinth passages 24 and completely fills their voids. The pressure of the water in the passages inside the matrix approaches that of the water in which the coating is submerged. Viscous damping occurs whenever the matrix is deformed by incident acoustic energy or sound waves (represented by the symbol 13 in FIG. 1) striking the surface of the coating. These cyclic shear deformations generated by acoustic waves deform the areas of the matrix surrounding the passages thereby in a pumping-like action cause water to flow to and fro in the passages and in and out of the matrix. As shown in the cross-sectional representation, the passages do not intersect with the embedded bodies or particles and therefore water does not penetrate their cavities or surrounding areas.

The inclusion of water within the matrix establishes an overall impedance more nearly matching that of the sea water, therefore waterborne sound waves readily penetrate the matrix with reduced reflection. It is desirable that the impedance of the coating match that of water at their interface so that sound waves are not aware of their transition from one medium to the other. The impedance of the coating must, however, be increased in a direction away from the water interface, otherwise there would be no absorption of the sound. The use of gradually changing acoustic properties by a series of layers of the coatings with increasing impedance is known, but is considered impractical for the present application. The effect, however, may be accomplished in the present disclosure by providing that passages 24 consume a greater percentage of the matrix adjacent the surface of water interface than inwardly toward the portion secured to the backing plate 14 or structure 10. This may be accomplished by increasing the size of the openings, or their occurrence, adjacent the water facing surface. The total volume occupied by the passages preferably decreases as they penetrate inwardly from the water interface.

One method of forming the labyrinth of passages 24 in the matrix is to initially include in the batch during formation a skeleton of soluble matted hair-like fibers and thereafter submerge the matrix in an appropriate bath such as water, acid, base or other chemical solution to dissolve them, thus leaving the cavernous passages.

One of the advantages of the present arrangement is that as a coating it is relatively insensitive to changing water pressure, as by depth, in which it would be submerged. This is attained by water penetrating into the body of the matrix with a resulting equalization of pressure.

Independent of pressure, sound waves incident upon the coating find areas of impedance mismatch within the matrix for causing cyclic internal deformations which internally deform to massage the material surrounding the passages to pump or otherwise move water back and forth within these passages and in and out of the matrix for causing viscous loss, thereby converting acoustic energy into heat energy.

There has been described one embodiment of the present invention. It will be obvious that various modifications and deviations may be made from this disclosure without departing from the substance of the invention which is defined by and limited only in the claims annexed hereto.

What is claimed is:

1. An absorber for absorbing waterborne sound waves comprising:

an elastomeric matrix having a surface in contact with the water and including a labyrinth running throughout the matrix, the passages of which are open to the surface and adapted to fill with water when submerged;

wherein said matrix includes portions of different acoustic impedance thereby establishing impedance mismatch for enhancing shear deformations in the matrix surrounding the water-filled labyrinth in response to the incident sound waves;

whereby sound waves incident upon the surface cause cyclic deformations within the matrix which imparts motion to the water within the labyrinth thereby converting acoustic energy into heat energy.

2. The invention as claimed in claim 1 wherein the labyrinth comprises randomly disposed tortuous passages many of which are interconnecting.

3. The invention as claimed in claim 1 wherein the labyrinth comprises randomly disposed passages rendering the matrix subject to shear deformations in response to incident sound waves.

4. The invention as claimed in claim 1 wherein passages of the labyrinth in communicating with the surface are of a size from about 1/1000 to about 1/100 of an inch.

5. The invention as claimed in claim 4 wherein the total volume of the matrix consumed by passages ranges from around 5% to around 70%.

6. The invention as claimed in claim 4 wherein the volume of the matrix consumed by passages is greater adjacent the water facing surface than internal of the matrix.

7. The invention as claimed in claim 6 wherein the passages are more numerous adjacent the water facing surface.

8. The invention as claimed in claim 6 wherein the passage are of a greater size adjacent the water facing surface.

9. The invention as claimed in claim 1 wherein the portions are bodies embedded within the matrix.

10. The invention as claimed in claim 9 wherein the bodies are rubber particles hermetically sealing a gas core.

11. The invention as claimed in claim 1 wherein the matrix is polymeric.

12. The invention as claimed in claim 11 wherein the matrix is rubber.

13. An anechoic and decoupling coating for the surface of an underwater structure for absorbing structure radiated acoustic energy and for intercepting and absorbing waterborne acoustic energy transmitted thereagainst from an external source thereby minimizing its reflection comprising:

a matrix adapted to be secured adjacent a surface of the structure with a face exposed to water;

said matrix being elastomeric and capable of deformation in response to waterborne acoustic energy;

said matrix including portions of different acoustic impedance thereby establishing areas of impedance mismatch;

said matrix including a labyrinth of tortuous passages running throughout which communicate with the water face and are adapted to fill with water when submerged;

whereby acoustic energy incident upon the matrix areas of impedance mismatch causes cyclic shear deformations in portions surrounding the water-filled passages thus imparting water movement within the passages and in and out of the matrix thereby converting acoustic energy into heat energy.

14. The invention according to claim 13 wherein the passages are of an opening size from about 1/1000 to about 1/100 of an inch.

15. The invention according to claim 13 or 14 in which the volume of the passages consume from about 5% to about 70% of the total volume of the matrix in which they are disposed.

16. The invention according to claim 15 in which the percentage of matrix volume consumed by the passages is greater adjacent the water face of the matrix than internally thereof.

17. The invention according to claim 15 wherein the passages are more numerous adjacent the water face of the matrix than internally thereof.

18. The invention according to claim 13 wherein the matrix is polymeric.

19. The invention according to claim 18 wherein the matrix is rubber.

20. The invention according to claim 13 wherein the portions of the matrix having different acoustic impedance comprise bodies embedded therein.

21. The invention according to claim 20 wherein the embedded bodies are resilient and hermetically seal a gas core.

22. The invention according to claim 20 wherein the bodies have varying degrees of acoustic mismatch.

23. A coating for the surface of an underwater structure for absorbing the passage therethrough of structure radiated sound waves and for intercepting waterborne sound waves directed toward said structure and preventing substantial reflection therefrom comprising:

a matrix of elastomeric material secured to the body with a surface exposed to the water and capable of deformation in response to sound waves;

said matrix having formed therein a labyrinth of extended passages which are in communication with said surface and adapted to fill with water when submerged;

said matrix including portions of different impedance whereby sound waves impinging thereon causes cyclic deformations of the matrix surrounding the passages for pumping the water to and fro within the passages whereby sound wave energy is converted to heat energy.

* * * * *